US005961390A

United States Patent [19]

Hoffman

[11] Patent Number: 5,961,390

[45] Date of Patent: Oct. 5, 1999

[54] STABLE SWING ARRANGEMENT

[76] Inventor: Donald E. Hoffman, 27 Pinebrook Rd., Wayland, Mass. 01778

[21] Appl. No.: 09/112,185

[22] Filed: Jul. 9, 1998

[51] Int. Cl.[6] ..... A63G 9/00

[52] U.S. Cl. ..... 472/118; 472/120

[58] Field of Search ..... 472/118, 120, 472/124; 482/52, 146, 147; 297/452.25, 452.24, 273

[56] References Cited

U.S. PATENT DOCUMENTS

| | | | |
|---|---|---|---|
| 3,177,036 | 4/1965 | Halter | 297/452.25 |
| 3,261,607 | 7/1966 | Horowitz et al. | 472/118 |
| 3,712,614 | 1/1973 | Sherman et al. | 472/118 |
| 5,334,099 | 8/1994 | Marra et al. | 472/118 |
| 5,338,260 | 8/1994 | Smith | 472/118 |
| 5,427,575 | 6/1995 | Berk | 472/118 |

FOREIGN PATENT DOCUMENTS

| | | | |
|---|---|---|---|
| 1457271 | 12/1976 | United Kingdom | 472/118 |
| 2207344 | 2/1989 | United Kingdom | 472/118 |

*Primary Examiner*—Kien T. Nguyen
*Attorney, Agent, or Firm*—Don Halgren

[57] ABSTRACT

The invention comprises a swing platform assembly for the safe securement and accommodation of a pair of user's feet, regardless of the size of the user, to permit the user to stand on the swing platform assembly for recreational swinging. The assembly comprises a planar panel of generally rectilinear configuration having an upper surface, a lower surface, a forward and a rearward edge, and a pair of side edges. A pair of support lines are arranged through an opening adjacent each of the side edges to permit the platform assembly to be supported off of the ground. A pair of elongated, generally parallel, multi-size foot-accommodating recesses are molded into the upper surface of planar panel, to allow any size foot to be maintained securely therein while swinging standing, without slippage of a user's foot from the swing assembly.

18 Claims, 2 Drawing Sheets

STABLE SWING ARRANGEMENT

BACKGROUND OF THE INVENTION

1. Field of the Invention

This invention relates to swing sets, and more particularly to the swing platform and the method of holding that swing platform from a support member.

2. Prior Art

The swing has been utilized as an instrument of recreation for many, many generations. During that time, swing designers have come up with approaches to utilize chairs and safety seats to minimize the dangers of such a swing. Often such chairs or a guide rail will not always accommodate larger children or young adults who may try to utilize those facilities.

It is an object of the present invention to provide a swing arrangement which may accommodate swing users of a wide range of ages and sizes.

It is a further object of the present invention to provide a swing arrangement which will help ensure the safety of such a swing user.

It is still yet a further object of the present invention to provide a novel and unique swing arrangement which is relatively inexpensively manufactured, and which may be retrofitable into existing swing assemblies.

It is still yet a further object of the present invention to provide a swing arrangement which is adjustable and safely lockable, to facilitate the accommodation of various user's recreation.

BRIEF SUMMARY OF THE INVENTION

The present invention relates to a swing platform assembly. The swing platform assembly is typically a planar panel manufactured from a molded thermoplastic material, having a side-to-side length typically of about 20 to 24 inches, and a front-to-back depth of about 14 to 18 inches. The platform assembly of the present invention has an upper surface and a lower surface. The upper surface of the platform assembly has a pair of spaced-apart, generally parallel, elongated recesses. Each of the pair of the parallel, spaced-apart, elongated recesses are directed in a front edge-to-back edge orientation. Each of those elongated recesses has a generally longitudinally directed center line which is about preferably 12 inches apart from its adjacent recess. Each recess has a lower-most surface, generally parallel to the upper surface of the platform assembly. The lower-most surface has a tapered wall which joins it to the upper-most surface of the platform assembly. The tapered wall in one embodiment lies at an angle of about 45 degrees with respect to the lower-most surface.

A further embodiment of the present invention comprises a series of steps between the lower-most surface of the depression and the upper-most surface of the platform assembly. Each step from the lower-most surface to the upper-most surface would comprise ridges into which a shoe or foot may be placed, depending upon the relative size of the shoe and the relative size of the depression and/or step extending therefrom. The depression or recess arrangement disposed in the upper-most surface of the platform assembly permits a user's foot to be placed therewithin. The recess edge, either the sloped wall or the stepped wall, reduces the likelihood of the user's foot slipping from the swing platform assembly while the swing is in use. The sloped wall or stepped-edged wall permits accommodating different sized feet, depending upon the particular foot and size characteristics of the user.

The assembly platform is held suspended beneath a swing support arm by a pair of lines or ropes arranged at each end of the support platform. A pair of openings are disposed between each end edge and its adjacent recess. The openings are spaced apart, so as to provide forward and rearward support to the assembly platform. The lower side of the support platform has a channel extending between the openings on each respective end of the platform assembly. The rope or line lies wedged in the channel extending between the openings and the platform assembly. The channel is defined by a pair of sidewalls, at least one of which is inclined with the respect to the other wall, so as to provide a wedging action against a rope or line disposed therewithin. The walls of the channel may also have serrations or friction means therein to prevent slippage or relative of motion between the rope or line and the channel in which it lies. Thus, a user of the platform assembly would not have the platform assembly move relative to the support line or rope which holds that platform assembly snugly in place.

A further embodiment of the present invention includes the utilization of a "bungee-type" type of stretch cord between an upper-most chain or rope suspended from the support member and the swing assembly platform itself. A lower-most first end of the bungee chord is inserted into or extends from a first opening in each end of the swing platform assembly. The bungee chord extends upwardly through a curved hanger at the lower-most end of the chain or rope suspended from the support member. The other end of the bungee chord extends downwardly and into a securing or locking mechanism at the side of the platform assembly. The locking mechanism may comprise a pair of opposed cam members arranged on a side face of the platform assembly, so as to bindingly engage the loose, lower-most (second) end of the bungee-type chord. A similar arrangement would be disposed for the other side of the platform assembly, providing both height adjustment and "bounce" adjustment to the platform assembly itself.

A yet further embodiment of the securing mechanism of the bungee chord comprises a wedge-shaped slot formed into the leading and the trailing edges of the platform assembly, to permit the bungee-type chord to be wedged therewithin, and to yet provide a further height and bounce adjustment to the elastic, bungee-type chord between the support chain and the platform assembly itself.

The invention thus comprises a swing platform assembly for the safe securement and accommodation of a pair of user's feet, regardless of the size of the user, to permit the user to stand on said swing platform assembly for recreational swinging, comprising: a planar panel of generally rectilinear configuration having an upper surface, a lower surface, a forward and a rearward edge, and a pair of side edges; a pair of support lines are arranged through an opening adjacent each of the side edges to permit the platform assembly to be supported off of the ground; and a pair of elongated, generally parallel, multi-size foot-accommodating recesses are molded into the upper surface of planar panel, to allow any size foot to be maintained securely therein while swinging standing, without slippage of a user's foot from the swing assembly.

The swing platform assembly has a channel formed in said lower surface thereof, between adjacent openings to permit the support lines to extend therein in a non-slip manner therewith.

The elongated recesses have a peripheral wall extending therearound, the wall permitting various size feet to be singly and securely accommodated therein. The elongated recesses each have a longitudinal axis, which axes are generally parallel to one another. The wall is sloped at an angle of about 45 degrees with respect to the lower surface of the recess, to permit a variety of different sized feet to be safely and securely singly accommodated therewithin. The wall may also be comprised of a plurality of step-like ridges, to permit a variety of different sized feet to be safely and securely singly accommodated therewithin.

The channels in the lower surface of the panel are sloped with respect to one another to permit a line extending therein to be wedged into a non-sliding relationship with the panel. The support lines are elastically elongatable. The support lines each have one end which is adjustably securable to a side edge of the panel to permit heightwise and stretch adjustment of the support lines. The panel may have a cammed lock therein for receipt and locking engagement of a support line therethrough. The panel may alternatively have a wedged shaped cutout in each said side edge of the panel, for locking receipt of a support line therein.

The invention also includes a method for adjusting the height and bounce characteristics of a stand-up swing assembly, comprising the steps of: arranging a planar panel swing supported by a pair of support lines; molding a pair of receiving openings into the panel; attaching an elasticized bungee cord through each of the receiving openings in the panel; looping a free end of the cord through a connector at a lower end of the pair of support lines; and connecting the free end of the cord to an adjustable locking arrangement on the panel to permit the cord to be tightly secured to the panel, thus allowing bounce and heightwise adjustment of the panel for use by different size and weight swingers. The locking arrangement on the panel may comprise a pair of pivotable cam members on a side of the panel, which are biasable from an open position to a line pinching position, to permit the line to be readily adjusted for differing weights and size users of the swing. The locking arrangement on the panel may comprise a wedged shaped slot molded onto a side of the panel, which slot securely pinches a line adjustably disposed therein, to permit the line to be readily adjusted for differing weights and size users of the swing. The method also includes the steps of: molding a pair of elongated generally oval foot shaped recesses in an upper surface of the panel to permit a user to insert the user's feet to be placed therein while using the swing, and forming a peripheral wall around the recesses to permit a variety of different size feet to be accommodated singly therein. The peripheral wall may be of sloping orientation with respect to the panel. The peripheral wall may alternatively be of stepped configuration.

BRIEF DESCRIPTION OF THE DRAWINGS

The objects and advantages of the present invention will be become more apparent when viewed in conjunction with the following drawings, in which.

DESCRIPTION OF THE PREFERRED EMBODIMENTS

Figure 1:
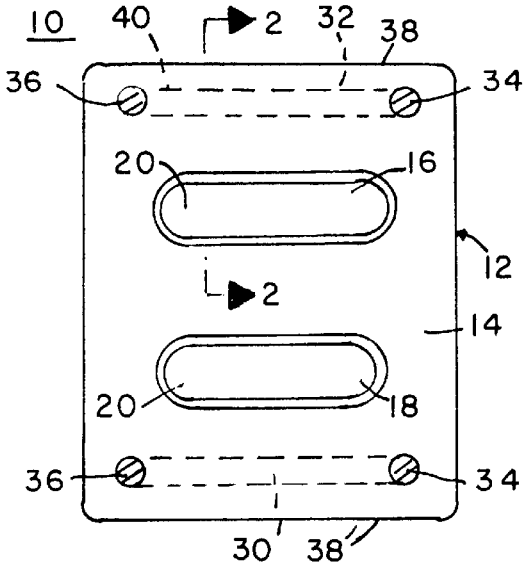
FIG. 1 is a plan view of a swing platform assembly constructed accorded to the principles of the present invention.

Referring to the drawings in detail, and particularly to FIG. 1, there is shown the present invention which relates to a swing platform assembly 10. The swing platform assembly 10 is typically a planar panel 12 manufactured from a molded thermoplastic material, having a side-to-side length typically of about 20 to 24 inches, and a front-to-back depth of about 14 to 18 inches. The platform assembly 12 of the present invention has an upper surface 14 and a lower surface 16. The upper surface 14 of the platform assembly 10 has a pair of spaced-apart, generally parallel, elongated recesses 16 and 18. Each of the pair of the parallel, spaced-apart, elongated recesses 16 and 18 are directed in a front-to-back edge orientation. Each of those elongated recesses 16 and 18 has a generally longitudinally directed center line L', which is about preferably 12 inches apart from its adjacent recess 16 or 18. Each recess 16 and 18 has a lower-most surface 20, generally parallel to the upper surface 14 of the platform assembly 12. The lower-most surface 14 of each of the recesses 16 and 18 has a tapered wall 22 which joins it to the upper-most surface 14 of the panel 12. The tapered wall 22 in one embodiment, lies at an angle of about 45 degrees with respect to the lower-most surface 20, as may be seen in FIG. 2.

Figure 2:
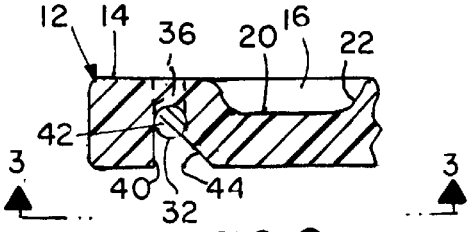
FIG. 2 is a view taken along the lines 2—2 of FIG. 1.
Figure 2A:
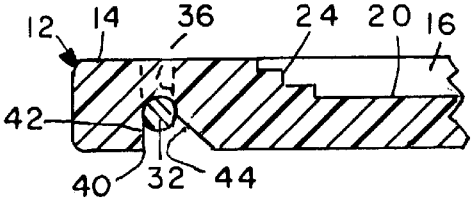
FIG. 2A is a view similar to FIG. 2, showing a further embodiment of the platform assembly.

A further embodiment of the present invention, as may be seen in FIG. 2A comprises a series of steps 24, between the lower-most surface 20 of each recess and the upper-most surface 14 of the panel 12. Each step from the lower-most surface 20 to the upper-most surface 14 would comprise ridges into which a shoe or foot may be placed, depending upon the relative size of the shoe and the relative size of the recess and/or step extending therefrom.

The depression or recess arrangement 16 and 18 disposed in the upper-most surface 14 of the platform assembly 12 permits a user's foot to be placed therewithin. The recess edge, either the sloped wall 22 or the stepped wall 24, reduces the likelihood of the user's foot slipping from the swing platform assembly 10 while the swing is in use. The sloped wall 22 or stepped-edged wall 24 permits the accommodation of different sized feet, depending upon the particular foot and size characteristics of the user.

Figure 3:
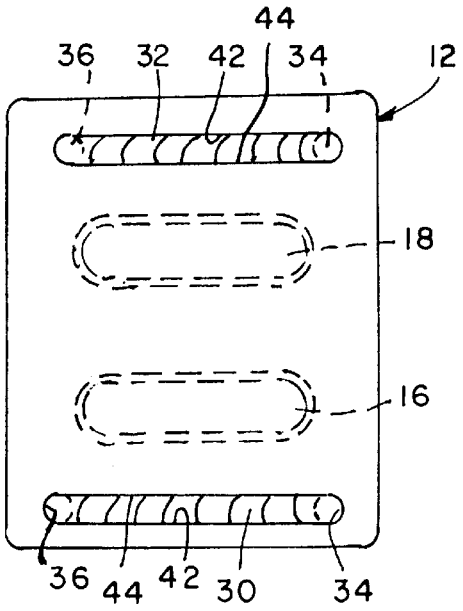
FIG. 3 is a view taken along the lines of 3—3 of FIG. 2.
Figure 4:
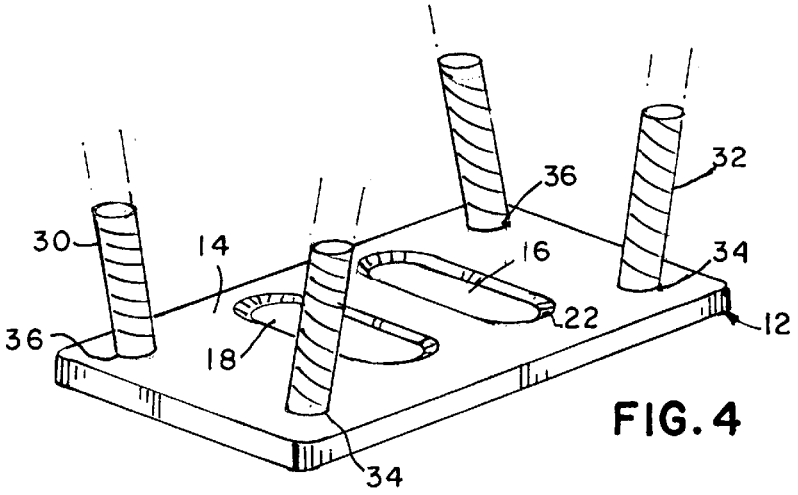
FIG. 4 is a perspective view of a platform swing assembly showing an arrangement of support lines extending therefrom.
Figure 5:
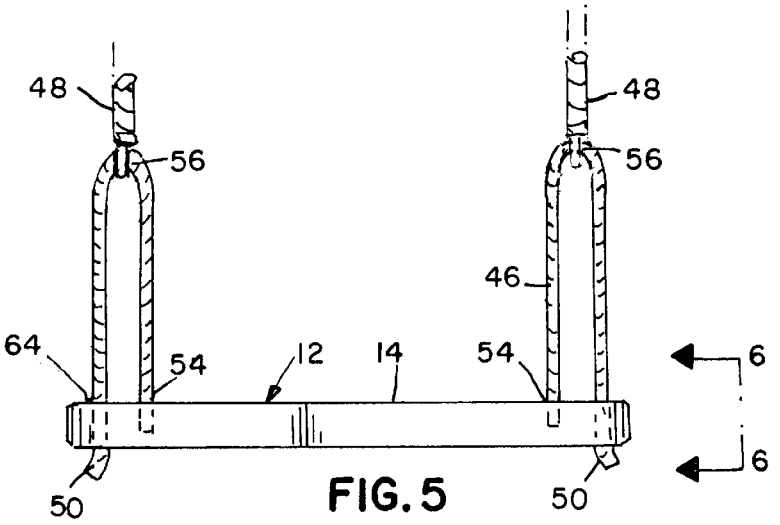
FIG. 5 is a side elevational view of a swing platform assembly and an adjustable, elastic support line extending therewith.

The assembly platform 12 is held suspended beneath a swing support arm, not shown for clarity, by a pair of lines or ropes 30 and 32 arranged at each end of the support platform 12, as shown in FIGS. 4 and 5. A pair of openings 34 and 36 are disposed between each end edge 38 and 38' and its adjacent recess 16 and 18. The openings 34 and 36 are spaced apart, so as to provide forward and rearward support to the assembly platform 12. The lower side 16 of the support platform 12 has a channel 40 extending between the openings 34 and 36 on each respective end of the platform assembly 12, as is shown in FIGS. 2 and 3. The rope or line 30 and 32 lies wedged in the channel 40 extending between the openings 34 and 36 and the platform assembly 12. The channel 40 is defined by a pair of sidewalls 42 and 44, at least one of which is inclined with the respect to the other wall, so as to provide a wedging action against a rope or line 30 or 32 disposed therewithin, as may be seen in FIG. 2. The walls 42 and 44 of the channel 40 may also have serrations or friction means therein to prevent slippage or relative of motion between the rope or line 30 or 32 and the channel 40 in which it lies. Thus, a user of the platform assembly 12 would not have the platform assembly 12 move relative to the support line or rope 30 and 32 which holds that platform assembly 12 snugly in place.

Figure 6:
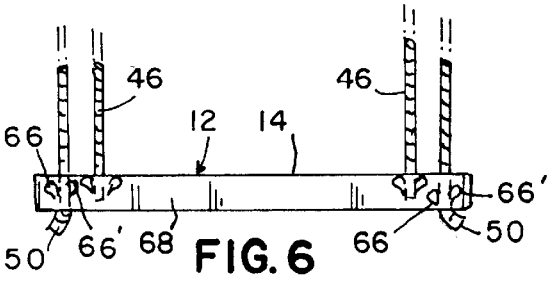
FIG. 6 is a view taken along the lines 6—6 of FIG. 5, showing a locking mechanism thus securing the support lines to the platform assembly.

A further embodiment of the present invention includes the utilization of a "bungee-type" type of stretch cord 46 between an upper-most chain or rope 48 suspended from the support member (not shown) and the swing assembly platform 12 itself, as shown in FIGS. 5 and 6. A lower-most first end 50 of the bungee chord 46 is inserted into or extends from a first opening 54 in each side of the swing platform assembly 12. The bungee chord 46 extends upwardly through a curved hanger 56 at the lower-most end of the chain or rope 48 suspended from the support beam or member, not shown. The other end 62 of the bungee chord 46 extends downwardly and into a securing or locking mechanism 64 at the side of the platform assembly 12. The locking mechanism 64 may comprise a pair of opposed cam members 66 and 66' arranged on a side face 68 of the platform assembly 12, so as to bindingly engage the loose, lower-most (second) end 62 of the bungee-type support chord 46. A similar arrangement would be disposed for the other side of the platform assembly, providing both height adjustment and "bounce" adjustment to the platform assembly itself.

Figure 7:
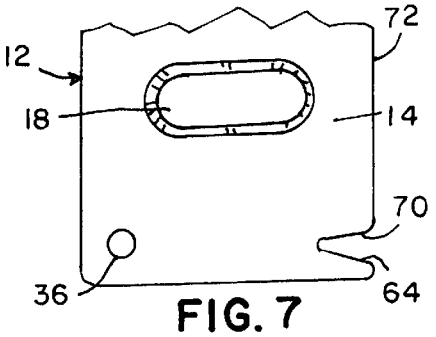
FIG. 7 is a view showing a further embodiment of a locking arrangement for adjustably locking the bungee-type chords, permitting adjustment thereof.

A yet further embodiment of the locking or securing mechanism 64 of the bungee chord 46 comprises a frictionally engaging wedge-shaped slot 70 formed into the leading edge 72 of the platform assembly 12, as shown in FIG. 7. This permits the bungee-type support chord 46 to be wedged therewithin, and to yet provide a further height and bounce adjustment to the elastic, bungee-type chord between the support chain and the platform assembly itself.

What is claimed is:

1. A swing platform assembly for the safe securement and accommodation of a pair of user's feet, regardless of the size of the user, to permit the user to stand on said swing platform assembly for recreational swinging, comprising:

a planar panel of generally rectilinear configuration having an upper surface, a lower surface, a forward and a rearward edge, and a pair of side edges;

a pair of support lines arranged through an opening adjacent each of said side edges to permit said platform assembly to be supported off of the ground; and a pair of elongated, generally parallel, foot shaped, multi-size foot-accommodating recesses molded into said upper surface of planar panel, to allow any size foot to be maintained securely within said foot shaped recesses while swinging standing, without slippage of user's foot from said swing assembly.

2. The swing platform assembly as recited in claim 1, wherein said planar panel has a channel formed in said lower surface thereof, between adjacent openings to permit said support lines to extend therein in a non-slip manner therewith.

3. The swing platform assembly as recited in claim 2, wherein said elongated foot shaped recesses have a peripheral wall extending therearound, said wall permitting various size feet to be singly and securely accommodated therein.

4. The swing platform assembly as recited in claim 3, wherein said elongated foot shaped recesses each have a longitudinal axis, which axes are generally parallel to one another.

5. The swing platform assembly as recited in claim 3, wherein said wall is sloped at an angle of about 45 degrees with respect to said lower surface of said foot shaped recess, to permit a variety of different sized feet to be safely and securely singly accommodated therewithin.

6. The swing platform assembly as recited in claim 3, wherein said wall is comprised of a plurality of step-like ridges, to permit a variety of different sized feet to be safely and securely singly accommodated therewithin.

7. The swing platform assembly as recited in claim 6, wherein said support lines each have one end which is adjustably securable to a side edge of said panel to permit heightwise and stretch adjustment of said support lines.

8. The swing platform assembly as recited in claim 2, wherein said channel in said lower surface of said panel are sloped with respect to one another to permit a line extending therein to be wedged into a non-sliding relationship with said panel.

9. The swing platform assembly as recited in claim 8, wherein said panel has a cammed lock therein for receipt and locking engagement of a support line therethrough.

10. The swing platform assembly as recited in claim 8, wherein said panel has a wedged shaped cutout in each said side edge of said panel, for locking receipt of a support line therein.

11. The swing platform assembly as recited in claim 1, wherein said support lines are elastically elongatable.

12. A method providing a stand-up swing assembly having adjustable height and bounce characteristics, comprising the steps of:

arranging a planar panel swing supported by a pair of support lines;

molding a pair of receiving openings in said panel;

attaching an elasticized bungee cord through each of said receiving openings in said panel;

looping a free end of said cord through a hanger arranged at a lower end of said pair of support lines; and adjustably locking said free end of said cord to a locking arrangement on said panel to permit said cord to be tightly secured to said panel, thus allowing bounce and heightwise adjustment of said panel for use by different size and weight swingers.

13. The method as recited in claim 12, wherein said locking arrangement on said panel comprises a pair of pivotable cam members on a side of said panel, which are biasable from an open position to a line pinching position, to permit said line to be readily adjusted for differing weights and size users of said swing.

14. The method as recited in claim 12, wherein said locking arrangement on said panel comprises a wedged shaped slot molded onto a side of said panel, which slot securely pinches a line adjustably disposed therein, to permit said line to be readily adjusted for differing weights and size users of said swing.

15. The method as recited in claim 12, including the step of:

molding a pair of elongated generally oval foot shaped recesses in an upper surface of said panel to permit a user to insert the user's feet to be placed therein while using said swing.

16. The method as recited in claim 15, including the step of:

forming a peripheral wall around said recesses to permit a variety of different size feet to be accommodated therein.

17. The method as recited in claim 16, wherein said peripheral wall is of sloping orientation with respect to said panel.

18. The method as recited in claim 16, wherein said peripheral wall has a stepped configuration.

* * * * *